US008644744B2

(12) United States Patent
Watanabe et al.

(10) Patent No.: US 8,644,744 B2
(45) Date of Patent: Feb. 4, 2014

(54) FIXING DEVICE AND IMAGE FORMING APPARATUS

(75) Inventors: Sho Watanabe, Ebina (JP); Yuichi Fukuda, Ebina (JP); Masaya Nakatsuhara, Ebina (JP); Tomoyuki Ito, Ashigarakami-gun (JP); Ryosuke Takahashi, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 425 days.

(21) Appl. No.: 12/902,726

(22) Filed: Oct. 12, 2010

(65) Prior Publication Data

US 2011/0188906 A1 Aug. 4, 2011

(30) Foreign Application Priority Data

Jan. 29, 2010 (JP) ..... 2010-019504

(51) Int. Cl.
*G03G 15/20* (2006.01)

(52) U.S. Cl.
USPC ..... 399/329; 399/328

(58) Field of Classification Search
USPC ..... 399/328, 329
See application file for complete search history.

(56) References Cited

U.S. PATENT DOCUMENTS

| | | | | |
|---|---|---|---|---|
| 5,890,047 | A | 3/1999 | Moser | |
| 5,937,231 | A * | 8/1999 | Aslam et al. | 399/328 X |
| 7,233,763 | B2 * | 6/2007 | Shiraishi | 399/329 |
| 7,349,660 | B2 * | 3/2008 | Domoto et al. | 399/328 |
| 2002/0118982 | A1 | 8/2002 | Fuma | |
| 2005/0089343 | A1 | 4/2005 | Mathers | |
| 2007/0092277 | A1 | 4/2007 | Miyata et al. | |

FOREIGN PATENT DOCUMENTS

| | | |
|---|---|---|
| JP | A-57-024975 | 2/1982 |
| JP | A-08-087191 | 4/1996 |
| JP | A-08-262889 | 10/1996 |
| JP | A 11-249469 | 9/1999 |
| JP | A 11-352819 | 12/1999 |
| JP | A-2004-205877 | 7/2004 |
| JP | A 2007-058249 | 3/2007 |

OTHER PUBLICATIONS

Office Action issued in Australian Patent Application No. 2010236039 dated Oct. 28, 2011.

Office Action issued in Australian Patent Application No. 2010236039 dated Jul. 7, 2011.

* cited by examiner

*Primary Examiner* — Sandra Brase
(74) *Attorney, Agent, or Firm* — Oliff PLC

(57) ABSTRACT

A fixing device includes: a fixing member that fixes a toner image on a recording medium; a pressure member that forms a fixing pressure portion between the pressure member and the fixing member by making pressure contact with an outer circumferential surface of the fixing member, the fixing pressure portion being passed through by the recording medium holding an unfixed toner image; a heat supplier that supplies heat to the fixing member; and a thermal diffusion member that diffuses heat on a surface of the fixing member by contact with the fixing member.

21 Claims, 6 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2010-019504 filed Jan. 29, 2010.

BACKGROUND

1. Technical Field

The present invention relates to a fixing device and an image forming apparatus.

2. Related Art

There has been known, as a fixing device used for an image forming apparatus such as a copying machine and a printer, a device including a heating member configured with a belt member (a fixing belt) that is provided with a tension by plural rolls.

SUMMARY

According to an aspect of the present invention, there is provided a fixing device including: a fixing member that fixes a toner image on a recording medium; a pressure member that forms a fixing pressure portion between the pressure member and the fixing member by making pressure contact with an outer circumferential surface of the fixing member, the fixing pressure portion being passed through by the recording medium holding an unfixed toner image; a heat supplier that supplies heat to the fixing member; and a thermal diffusion member that diffuses heat on a surface of the fixing member by contact with the fixing member.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the attached drawings.

<Description of Image Forming Apparatus>

Figure 1:
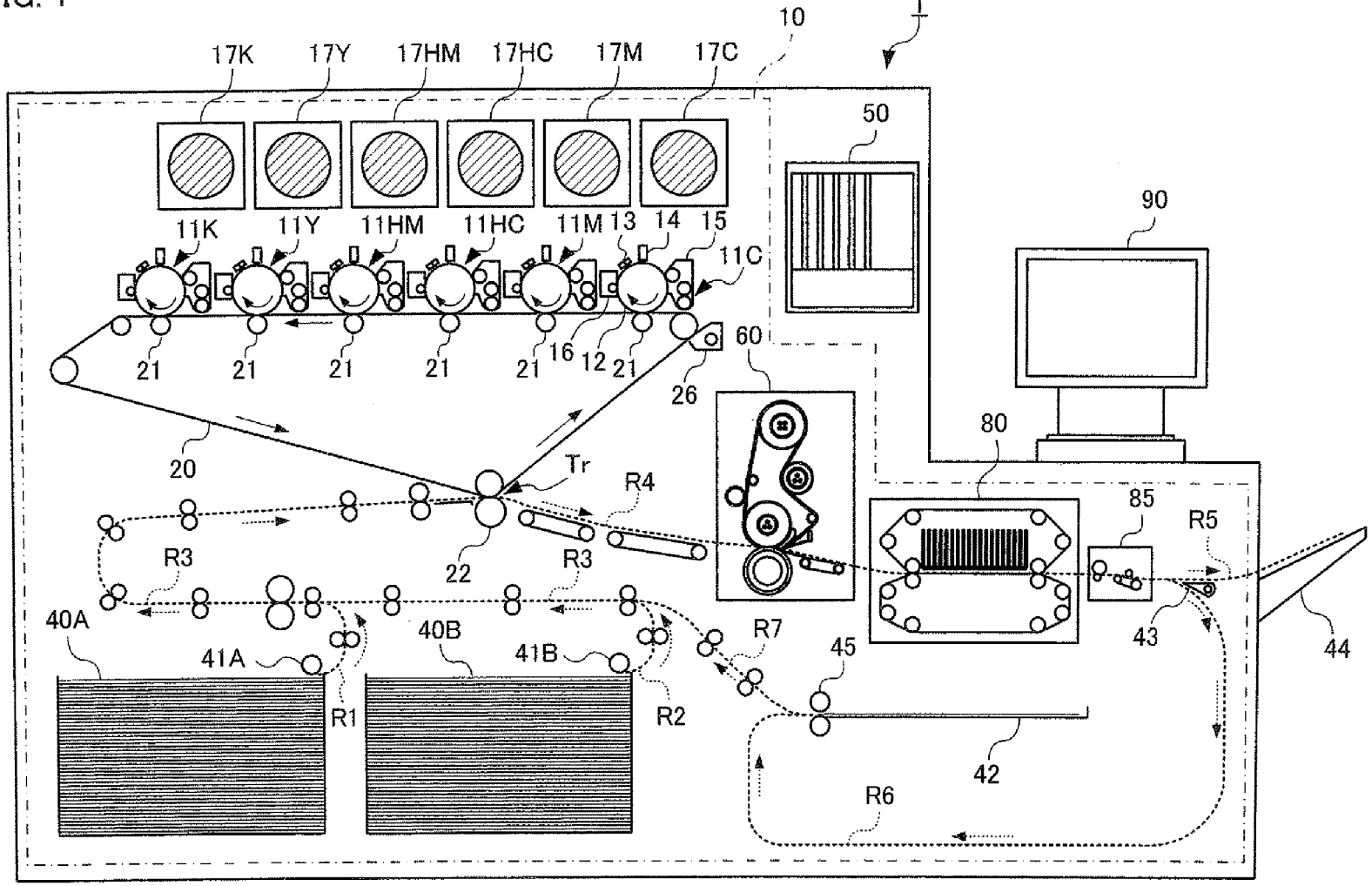
FIG. 1 illustrates a configuration example of an image forming apparatus to which a fixing unit related to an exemplary embodiment is applied.

FIG. 1 illustrates a configuration example of an image forming apparatus 1 employing a fixing unit (fixing device) 60 according to the exemplary embodiment. The image forming apparatus 1 shown in FIG. 1 is a so-called "tandem-type" color printer, and includes: an image forming portion 10 that forms an image based on image data; a main controller 50 that performs overall control of operations of the image forming apparatus 1, communication with, for example, a personal computer (PC) or the like, image processing for image data, and the like; and a user interface (UI) portion 90 that receives an operation input from a user and displays various kinds of information to the user.

<Description of Image Forming Portion>

The image forming portion 10 is a functional portion for forming an image using for example, an electrophotographic system, and includes six image forming units 11C, 11M, 11HC, 11HM, 11Y, 11K (hereinafter, referred to as "image forming units 11") arranged in parallel, provided as an example of a toner image forming unit. As functional members, each image forming unit 11 includes, for example, a photoconductive drum 12, a charging device 13, an exposure device 14, a developing device 15, and a cleaner 16. On the photoconductive drum 12, an electrostatic latent image is formed, and then a toner image of a certain color is formed. The charging device 13 charges the surface of the photoconductive drum 12 at a predetermined potential. Based on image data, the exposure device 14 exposes the photoconductive drum 12 charged by the charging device 13. The developing device 15 develops the electrostatic latent image formed on the photoconductive drum 12 by toner of the certain color. The cleaner 16 cleans the surface of the photoconductive drum 12 after transfer.

The developing device 15 of each image forming unit 11 is connected, through a toner supply path (not shown), to a corresponding one of toner containers 17C, 17M, 17HC, 17HM, 17Y, 17K (hereinafter, referred to as "toner containers 17") storing toner of respective colors. The toner containers 17 replenish the developing devices 15 with toner of respective colors using replenishment screws (not shown) provided in the toner supply paths.

The image forming units 11 have almost the same configuration except for the color of toner contained in the developing devices 15. The image forming units 11 form toner images of cyan (C), magenta (M), highly saturated cyan (HC), highly saturated magenta (HM), yellow (Y), and black (K), respectively. Here, HC is cyan having a cyan hue and having a brighter color tone and a higher saturation than C. HM is magenta having a magenta hue and having a brighter color tone and a higher saturation than M.

In addition, the image forming portion 10 includes: an intermediate transfer belt 20 on which the toner images of the respective colors formed on the photoconductive drums 12 of the image forming units 11 are transferred; and primary transfer rolls 21 that transfer the toner images of the respective colors formed on the photoconductive drums 12 of the image forming units 11 onto the intermediate transfer belt 20 (primary transfer). The image forming portion 10 further includes: a secondary transfer roll 22 that collectively transfers the toner images of the respective colors that have been transferred onto the intermediate transfer belt 20 in an superimposed manner onto a sheet being a recording medium (secondary transfer); and the fixing unit 60, as an example of a fixing device, that fixes the toner images of the respective colors after the secondary transfer onto the sheet.

In addition, the image forming portion 10 includes: a cooling unit 80 that cools the toner images of the respective colors fixed onto the sheet by the fixing unit 60 so that toner images of the respective colors are more securely fixed onto the sheet; and a curl correction unit 85 that corrects a curl in the sheet.

Note that in the image forming apparatus 1 of the exemplary embodiment, a transfer unit is formed of the intermediate transfer belt 20, the primary transfer rolls 21, and the secondary transfer roll 22. Further, an area where the secondary transfer roll 22 is placed and where the toner images of the respective colors on the intermediate transfer belt 20 are transferred onto the sheet through the secondary transfer is hereinafter referred to as "secondary transfer area Tr."

<Description of Sheet Transport System>

As a sheet transport system, the image forming portion 10 includes: multiple (two in the exemplary embodiment) sheet containers 40A and 40B that hold sheets; pick-up rolls 41A and 41B that pick up a sheet held in the sheet containers 40A and 40B, respectively, and transport the sheet; a first transport path R1 for transporting the sheet from the sheet container 40A; and a second transport path R2 for transporting the sheet from the sheet container 40B. The image forming portion 10 further includes a third transport path R3 for transporting the sheet from the sheet container 40A or 40B toward the secondary transfer area Tr. Moreover, the image forming portion 10 includes: a fourth transport path R4 for transporting the sheet onto which the toner images of the respective colors are transferred at the secondary transfer area Tr, so that the sheet passes the fixing unit 60, the cooling unit 80, and the curl correction unit 85; and a fifth transport path R5 for transporting the sheet from the curl correction unit 85 toward a sheet stacking portion 44 provided at an exit portion of the image forming apparatus 1.

Transport rolls and transfer belts are arranged along the first transport path R1 to the fifth transport path R5, sequentially transporting a sheet being fed.

<Description of Duplex Transport System>

As a duplex transport system, the image forming portion 10 includes: an intermediate sheet container 42 that temporarily holds the sheet having a first surface onto which the toner images of the respective colors are fixed; a sixth transport path R6 for transporting the sheet from the curl correction unit 85 toward the intermediate sheet container 42; and a seventh transport path R7 for transporting the sheet held in the intermediate sheet container 42 toward the third transporting path R3 described above. The image forming portion 10 further includes: a switching mechanism 43 that is placed downstream of the curl correction unit 85 in a sheet transport direction, and that selectively switches the transport direction of the sheet between the fifth transport path R5 for transporting the sheet toward the sheet stacking portion 44 and the sixth transport path R6 for transporting the sheet toward the intermediate sheet container 42; and pick-up rolls 45 that pick up the sheet held in the intermediated sheet container 42 and transport the sheet toward the seventh transport path R7.

<Description of Image Forming Operations>

Next, a description is given of basic image forming operations of the image forming apparatus 1 according to the exemplary embodiment.

The image forming units 11 of the image forming portion 10 form toner images of colors of C, M, HC, HM, Y, and K, respectively, by an electrophotographic process using the above-described functional members. The primary transfer rolls 21 sequentially transfer the toner images of the respective colors formed on the respective image forming units 11 onto the intermediate transfer belt 20 (primary transfer) to form a composite toner image in which the toner images of the respective colors are superimposed on one another. Along with the movement of the intermediate transfer belt 20 (arrow direction), the composite toner image on the intermediate transfer belt 20 is transported to the secondary transfer area Tr where the secondary transfer roll 22 is placed.

Meanwhile, in the sheet transport system, according to the timing at which the image forming units 11 start image formation, the pick-up roll 41A or 41B rotates and picks up a sheet from the sheet container 40A or 40B, whichever is designated by the UI portion 90, for example. The sheet picked up by the pick-up roll 41A or 41B is transported along the first transport path R1 or the second transport path R2 and then by the third transport path R3, and reaches the secondary transfer area Tr.

In the secondary transfer area Tr, the composite toner image held on the intermediate transfer belt 20 is collectively transferred to the sheet by a transfer electric field formed by the secondary transfer roll 22 (secondary transfer).

Thereafter, the sheet to which the composite toner image is transferred is separated from the intermediate transfer belt 20 and is transported to the fixing unit 60 along the fourth transport path R4. The composite toner image on the sheet transported to the fixing unit 60 is subjected to a fixing process by the fixing unit 60 and is thus fixed onto the sheet. Then, the sheet having the fixed image formed thereon is cooled by the cooling unit 80, and a curl of the sheet is then corrected by the curl correction unit 85. After that, in a simplex printing mode, the sheet having passed the curl correction unit 85 is led by the switching mechanism 43 to the fifth transport path R5 and is transported toward the sheet stacking portion 44.

Note that the cleaner 16 remove toner attached to the photoconductive drums 12 after the primary transfer (residual toner after primary transfer), and a belt cleaner 26 removes toner attached to the intermediate transfer belt 20 after the secondary transfer (residual toner after secondary transfer).

In a duplex printing mode, on the other hand, the sheet having the first surface onto which the image is fixed by the above described process passes the curl correction unit 85 and then is led by the switching mechanism 43 to the sixth transport path R6 to be transported to the intermediate sheet container 42. Then, according to the timing at which the image forming units 11 start image formation on a second surface of the sheet, the pick-up rolls 45 rotate and pick up the sheet from the intermediate sheet container 42. The sheet picked up by the pick-up rolls 45 is transported along the seventh transport path R7 and the third transport path R3, and reaches the secondary transfer area Tr.

In the secondary transfer area Tr, as in the case of the first surface, the composite toner image for the second surface held on the intermediate transfer belt 20 is collectively transferred onto the sheet by a transfer electric field formed by the secondary transfer roll 22 (secondary transfer).

Then, as in the case of the first surface, the sheet having the toner image transferred on both surfaces undergoes fixing at the fixing unit 60, is cooled by the cooling unit 80, and a curl of the sheet is corrected by the curl correction unit 85. After that, the sheet having passed the curl correction unit 85 is led by the switching mechanism 43 to the fifth transport path R5 and is transported toward the sheet stacking portion 44.

In a manner described above, the cycle of the image formation process of the image forming apparatus 1 is repeated in cycles for the number of prints to be produced.

<Description of Fixing Unit Configuration>

Next, a description is given of the fixing unit 60 used in the image forming apparatus 1 of the exemplary embodiment.

Figure 2:
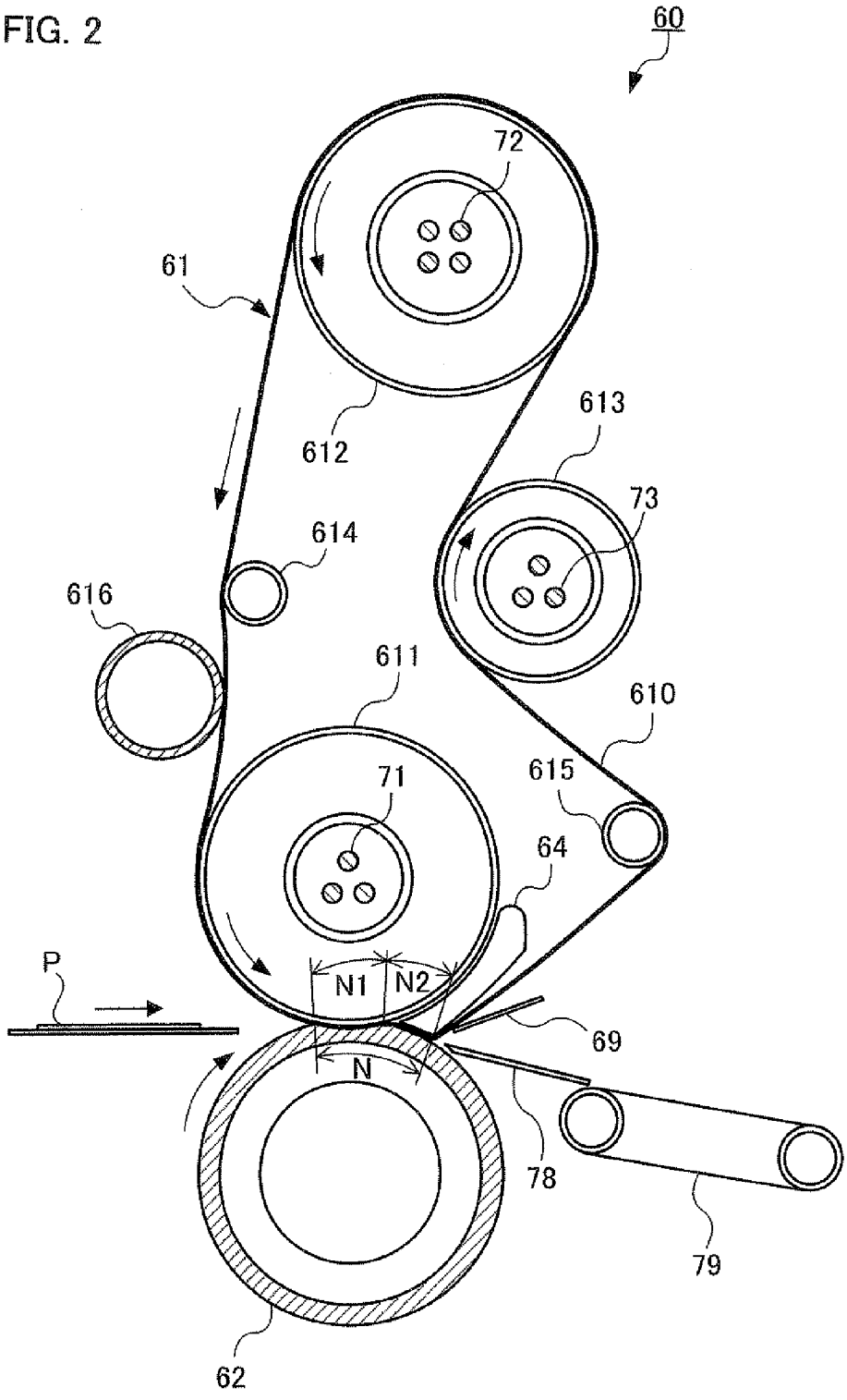
FIG. 2 is a cross-sectional view illustrating the configuration of the fixing unit of the exemplary embodiment.

FIG. 2 is a cross-sectional view illustrating the configuration of the fixing unit 60 of the exemplary embodiment. As main parts, the fixing unit 60 includes a fixing belt module 61 and a pressure roll 62. The pressure roll 62 is an example of a pressure member configured to be contactable with and separable from the fixing belt module 61.

The fixing belt module 61 includes a fixing belt 610, a fixing roll 611, an inside heating roll 612, and an outside heating roll 613. The fixing belt 610 is an example of a fixing member that fixes a toner image on a sheet P. The fixing roll 611 is a tensioning member that is placed facing the pressure roll 62 with the fixing belt 610 interposed therebetween and that rotates while providing a tension to the fixing belt 610. The fixing roll 611 heats the fixing belt 610 from the inside at a nip portion (fixing pressure portion) N which is an area where the fixing belt module 61 and the pressure roll 62 are in pressure contact with each other (in contact while pressing each other). The inside heating roll 612 heats the fixing belt 610 while providing a tension to the fixing belt 610 from the inside. The outside heating roll 613 heats the fixing belt 610 while providing a tension to the fixing belt 610 from the outside. The fixing belt module 61 also includes a tensioning roll 614, a peeling pad 64, a tensioning roll 615, and a thermal diffusion roll 616. The tensioning roll 614 provides a tension to the fixing belt 610 between the fixing roll 611 and the inside heating roll 612 (upstream of nip portion N). The peeling pad 64 is an example of a peeling member placed downstream of the nip portion N and adjacent to the fixing roll 611. The tensioning roll 615 provides a tension to the fixing belt 610, downstream of the nip portion N. The thermal diffusion roll 616, which will be described in detail later, is an example of a thermal diffusion member as well as an example of a temperature gradient relieving unit.

The fixing belt 610 is formed of a base layer made of, for example, a polyimide resin, an elastic layer stacked on a surface side (outer circumferential side) of the base layer and made of a silicon rubber, and a release layer covering the elastic layer and made of a PFA (tetrafluoroethylene-perfluoro alkyl vinyl ether copolymer resin). Here, the elastic layer is provided particularly to improve the quality of color images. Specifically, a toner image held on the sheet P, which is to be fixed later, is formed by laminating powder toners of respective colors. For this reason, to apply heat evenly to the entire toner image at the nip portion N, the surface of the fixing belt 610 may desirably change shape according to the surface unevenness of the toner image on the sheet P.

The fixing roll 611 is a hollow cylindrical roll formed of aluminum or SUS, for example, and coated with PFA, and rotates in a direction shown by an arrow in FIG. 2 by a rotational driving force of a drive motor (not shown). Then, the fixing roll 611 is heated to a predetermined temperature (e.g., 150° C.) by for example three halogen heaters 71 placed inside the fixing roll 611 as a heat source.

The inside heating roll 612 is a cylindrical roll formed of aluminum or SUS, for example. The inside heating roll 612 is heated to a predetermined temperature (e.g., 190° C.) by for example four halogen heaters 72 placed inside as a heat source.

Further, at both end portions, the inside heating roll 612 is provided with spring members (not shown) that press the fixing belt 610 from the inside to the outside, setting the overall tension of the fixing belt 610 to, for example, 15 kgf.

The inside heating roll 612 is further provided with a mechanism for controlling meandering (belt walk) of the fixing belt 610. Specifically, a belt edge position detecting mechanism (not shown) is provided near the inside heating roll 612 to detect the position of an edge of the fixing belt 610. The inside heating roll 612 is further provided with a displacement mechanism (not shown) for displacing one of edge portions of the inside heating roll 612 in a direction orthogonal to an axis direction of the inside heating roll 612. The displacement mechanism displaces the fixing belt 610 in the axis direction of the inside heating roll 612 by displacing one of the edge portions of the inside heating roll 612 according to a detection result of the belt edge position detecting mechanism. The belt walking of the fixing belt 610 is thus controlled.

The outside heating roll 613 is a cylindrical roll formed of aluminum or SUS, for example. The outside heating roll 613 is heated to a predetermined temperature (e.g., 190° C.) by for example three halogen heaters 73 placed inside as a heat source.

As described, the fixing unit 60 of the exemplary embodiment employs a configuration in which the fixing belt 610 is heated by the fixing roll 611, the inside heating roll 612, and the outside heating roll 613. In other words, the fixing roll 611, the inside heating roll 612 and the outside heating roll 613 may be captured as a heat supplier that supplies heat required to perform fixing to the fixing belt 610.

The peeling pad 64 is a block member having a substantially arc-shaped cross section and being formed of a rigid body such as a metal like SUS or a resin. Over the entire area of the fixing roll 611 in the axis direction, the peeling pad 64 is placed to be secured at a position downstream of and adjacent to an area where the pressure roll 62 is in pressure contact with the fixing roll 611 with the fixing belt 610 interposed therebetween (hereinafter, referred to as "roll nip portion N1"). The peeling pad 64 is installed to evenly press an area of a predetermined width (e.g., a 5-mm nip width in a traveling direction of the fixing belt 610) of the pressure roll 62 with the fixing belt 610 interposed therebetween with a predetermined load (e.g., 10 kgf average). The peeling pad 64 forms a "peeling pad nip portion N2" next to the roll nip portion N1.

The pressure roll 62 is a member that forms the nip portion N between itself and the fixing belt 610 by being pressed against the outer circumferential surface of the fixing belt 610. The nip portion N is where the sheet P holding an unfixed toner image passes. For example, the pressure roll 62 has a hollow cylindrical roll formed of aluminum or SUS as a base on which an elastic layer formed of a silicon rubber and a release layer formed of a PFA tube are sequentially laminated in this order. The pressure roll 62 is placed to be contactable with and separable from the fixing belt module 61. When in contact (pressure contact) with the fixing belt module 61 while pressing thereagainst, the pressure roll 62 rotates in a direction shown by an arrow, driven by the fixing roll 611 of the fixing belt module 61 rotating in another direction shown by an arrow.

<Description of Fixing Operations of Fixing Unit>

Next, a description is given of fixing operations of the fixing unit 60 of the exemplary embodiment.

The sheet P on which a composite toner image (unfixed toner image) is electrostatically transferred at the secondary transfer area Tr (refer to FIG. 1) of the image forming apparatus 1 is transported toward the nip portion N (refer to FIG. 2) of the fixing unit 60 along the fourth transport path R4 (refer to FIG. 1). Then, the unfixed toner image held on the surface of the sheet P passing the nip portion N is fixed onto the sheet P by pressure and heat acting mainly on the roll nip portion N1.

Specifically, in the fixing unit 60 of the exemplary embodiment, heat acting on the roll nip portion N1 is supplied mainly by the fixing belt 610. The fixing belt 610 is heated by: heat supplied through the fixing roll 611 from the halogen heaters 71 placed inside the fixing roll 611; heat supplied through the inside heating roll 612 from the halogen heaters 72 placed inside the inside heating roll 612; and heat supplied through the outside heating roll 613 from the halogen heaters 73 placed inside the outside heating roll 613. Thus, heat energy is supplied from not only the fixing roll 611, but also the inside heating roll 612 and the outside heating roll 613. Consequently, a sufficient amount of heat may be obtained in the roll nip portion N1 even at a high process speed.

In the fixing unit 60 of the exemplary embodiment, the fixing belt 610 functioning as a direct-heating member may be configured with an extremely small heat capacity. In addition, the fixing belt 610 is configured to be in contact with each of the heat supplying members, the fixing roll 611, the inside heating roll 612, and the outside heating roll 613, with a large wrap area (a large wrap angle). Consequently, the sufficient amount of heat is supplied from the fixing roll 611, the inside heating roll 612, and the outside heating roll 613 in a short cycle in which the fixing belt 610 rotates one revolution. Accordingly, it takes only a short time for the fixing belt 610 to regain a temperature capable of fixing. Thereby, a predetermined fixing temperature is maintained at the roll nip portion N1.

As a result, even when sheets pass the fixing unit 60 of the exemplary embodiment successively at a high speed, the fixing unit 60 keeps its fixing temperature almost constant. Moreover, occurrence of a phenomenon in which the fixing temperature drops upon initiation of high-speed fixing operations (so-called "temperature droop phenomenon") is prevented. In particular, even in fixing to a thick sheet or the like requiring a large heat capacity, the fixing temperature is maintained and occurrence of the temperature droop phenomenon is prevented. Furthermore, because the fixing belt 610 has a small heat capacity, when the fixing temperature needs to be changed in the middle of the operations, depending on a sheet type (increasing and decreasing of the fixing temperature), the fixing temperature is easily changeable by adjusting outputs of the halogen heaters 71, the halogen heaters 72, and the halogen heaters 73.

Further, in the fixing unit 60 of the exemplary embodiment, the fixing roll 611 is a hard roll formed of aluminum, SUS, or the like, and the pressure roll 62 is a soft roll covered with an elastic layer. Accordingly, a nip area having a certain width in the traveling direction of the fixing belt 610 is formed in the roll nip portion N1, where the fixing roll 611 hardly deforms, while the surface of the pressure roll 62 deforms. As described, the side of the fixing roll 611 which is wrapped by the fixing belt 610 hardly changes shape in the roll nip portion N1. For this reason, the fixing belt 610 passes the roll nip portion N1 while keeping the moving speed almost constant. This prevents the fixing belt 610 from creasing or being deformed in the roll nip portion N1, so that a fixed image of good quality may be provided.

Subsequently, after passing the roll nip portion N1, the sheet P is transported to the peeling pad nip portion N2. In the peeling pad nip portion N2, the peeling pad 64 is pressed against the pressure roll 62, and the fixing belt 610 is in pressure contact with the pressure roll 62. Accordingly, the roll nip portion N1 has a shape curving downward due to the curvature of the fixing roll 611, whereas the peeling pad nip portion N2 has a shape that follows a shape of a contact surface between the fixing belt 610 and the peeling pad 64 having a surface processed to be substantially flat.

Accordingly, the sheet P heated and pressed under the curvature of the fixing roll 611 in the roll nip portion N1 changes its traveling direction in the peeling pad nip portion N2 according to the curvature of the pressure roll 62 which is curved in an opposite direction. In this direction change, an extremely little slippage occurs between the toner image on the sheet P and the surface of the fixing belt 610. Thereby, adhesion between the toner image and the fixing belt 610 weakens, facilitating the sheet P to be peeled off the fixing belt 610. Hence, the peeling pad nip portion N2 may be regarded as a preparation step for secure peeling in a final peeling step.

Then, since the fixing belt 610 is transported so as to wind around the peeling pad 64 in an exit of the peeling pad nip portion N2, the transport direction of the fixing belt 610 drastically changes at this exit. To be more specific, since the fixing belt 610 moves along the outer surface of the peeling pad 64, the fixing belt 610 is caused to form a large curve. For this reason, the sheet P whose adhesion to the fixing belt 610 is weakened in the peeling pad nip portion N2 is separated from the fixing belt 610 by the resiliency of the sheet P itself.

Then, the traveling direction of the sheet P separated from the fixing belt 610 is led by a peeling guide plate 69 placed downstream of the peeling pad nip portion N2. The sheet P guided by the peeling guide plate 69 is thereafter transported toward the cooling unit 80 (refer to FIG. 1) by an exit guide 78 and by an exit belt 79. More specifically, the peeling guide plate 69 is a member that separates the sheet P peeled off the fixing belt 610 from the fixing belt 610 completely, and that sets a traveling direction of the sheet P. The exit guide 78 and the exit belt 79 are members that smoothly guide, toward the cooling unit 80, the sheet P for which the traveling direction is set by the peeling guide plate 69.

With the operations described above, the fixing process of the fixing unit 60 is completed.

<Description of Thermal Diffusion Roll>

As described above, in the nip portion N, an unfixed toner image is fixed onto the sheet P by the heat supplied from the fixing roll 611, the inside heating roll 612 and the outside heating roll 613 to the fixing belt 610 and the pressure applied by the pressure roll 62. On this occasion, the heat accumulated in the fixing belt 610 is transmitted to the sheet P to be taken away. Accordingly, in the part of the surface of the fixing belt 610 that is in contact with the sheet P, the temperature is decreased. On the other hand, in the part of the surface of the fixing belt 610 that is not in contact with the sheet P, the temperature is maintained since the heat is not taken away. This is not only true for the case where only one sheet P is supplied to perform fixing, but also for the case where the plural sheets P are successively supplied. When the sheets P are successively supplied, it is impossible to successively perform fixing without any gap. Therefore, the sheets P are supplied to the fixing unit 60 at predetermined intervals. As a result, in the fixing belt 610, the part that comes into contact with the sheet P and the part that does not come into contact with the sheet P alternately occur. In the surface of the fixing belt 610, the part where the temperature decreases (low temperature portion) and the part where the temperature is maintained (high temperature portion) alternately occur, thus causing a difference in temperature. It should be noted that, in the exemplary embodiment, such a difference in temperature caused in the fixing belt 610 is referred to as a temperature variation or a temperature gradient in some cases.

In the case where such a temperature variation occurs in a part of the fixing belt 610, and the temperature variation is not eliminated until the time when the part reaches the nip portion N again by the rotation of the fixing belt 610, there sometimes occurs a case where fixing is performed by causing both high temperature portion and low temperature portion with a difference in temperature to be brought into contact with a single sheet P. The temperature variation in the fixing belt 610 has an effect on the gloss level of the fixed toner image. That is to say, in the case where the fixing is performed by the high temperature portion of the fixing belt 610, the fixed toner image has a high gloss level. On the other hand, in the case where the fixing is performed by the low temperature portion of the fixing belt 610, the fixed toner image has a low gloss level. Consequently, parts of high gloss level and parts of low gloss level are mixed in the single sheet P, thus causing a difference in the gloss level (gloss variation).

Figure 3:
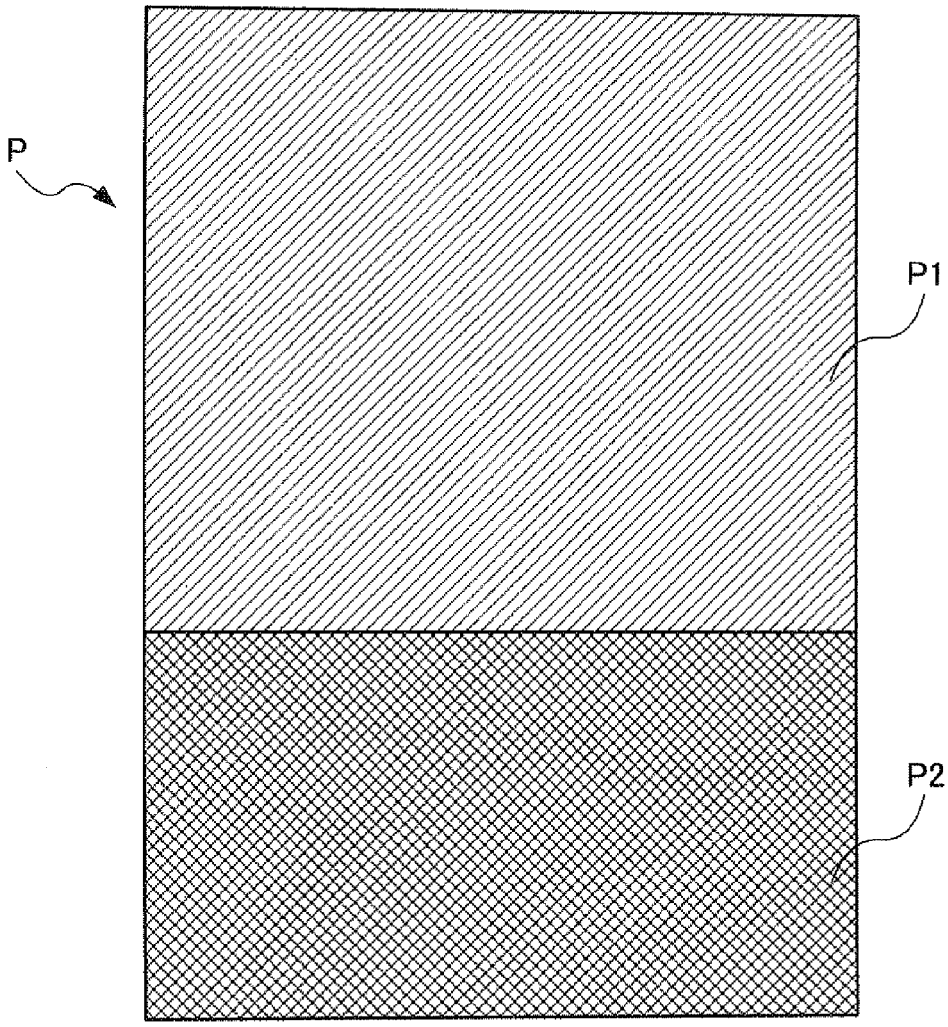
FIG. 3 is a conceptual diagram that illustrates variations in gloss level when fixing is carried out by a fixing belt in which temperature variation occurs.

FIG. 3 is a conceptual view illustrating gloss variation when fixing is performed by the fixing belt 610 in which the temperature variation occurs.

The sheet P shown in FIG. 3 indicates the case where the sheet P is first subjected to fixing by the low temperature portion of the fixing belt 610, and in midstream, subjected to fixing by the high temperature potion of the fixing belt 610. In this case, the region indicated as P1 in the sheet P has a low gloss level, and the region indicated as P2 has a high gloss level. In short, when fixing is performed on the sheet P, change of the gloss level occurs in midstream. Since there is a difference in the gloss level between the region P1 and the region P2, the difference is recognized as gloss variation.

It is difficult to suppress the temperature variation by adjusting outputs of the halogen heaters 71, the halogen heaters 72 and the halogen heaters 73 as described above. Specifically, though the outputs of the halogen heaters 71, the halogen heaters 72 and the halogen heaters 73 are adjusted, it requires several seconds to propagate effects to the fixing roll 611, the inside heating roll 612, the outside heating roll 613, and further, the fixing belt 610. On the other hand, the fixing belt 610 rotates at high speed. Accordingly, it is difficult to perform control to suppress the temperature variation on the surface of the fixing belt 610 in terms of time.

Consequently, in the exemplary embodiment, the thermal diffusion roll 616 is provided to suppress the gloss variation. As shown in FIG. 2, in the exemplary embodiment, the thermal diffusion roll 616 is arranged to a position that is on the side of inserting the sheet P and is adjacent to the nip portion N. The thermal diffusion roll 616 comes into contact with the fixing belt 610 at this position and rotates along with the movement of the fixing belt 610, thus diffusing the heat on the surface of the fixing belt 610. As a result, difference in temperature caused on the surface of the fixing belt 610 is reduced, and thereby the temperature variation is suppressed. Further, the image quality is ensured by suppressing the gloss variation in the fixed toner image. It should be noted that the thermal diffusion roll 616 may be captured as a temperature gradient relieving unit that relieves the temperature gradient of the fixing belt 610 caused after fixing of the toner image by coming into contact with the fixing belt 610.

In the exemplary embodiment, it is possible to cause thermal diffusion more quickly by employing the configuration in which the thermal diffusion roll 616 is brought into contact with the fixing belt 610. From this point of view, the area of contact between the thermal diffusion roll 616 and the fixing belt 610 may be larger. Accordingly, so-called wrap length, which is a length of the fixing belt 610 wrapping on the thermal diffusion roll 616, may be longer.

In the exemplary embodiment, the surface temperature of the thermal diffusion roll 616 may be a temperature between the high temperature portion and the low temperature portion on the surface of the fixing belt 610 (intermediate temperature). Accordingly, the thermal diffusion roll 616 absorbs heat from the high temperature portion and supplies heat to the low temperature portion on the surface of the fixing belt 610, thus efficiently performing thermal diffusion. For this reason, the temperature of the thermal diffusion roll 616 may be raised to the intermediate temperature more quickly. In the exemplary embodiment, to achieve the quick rise of temperature, the thermal diffusion roll 616 is configured to have a hollow portion inside thereof. Specifically, heat capacity of the entire thermal diffusion roll 616 is decreased by providing the hollow portion, and accordingly, the surface temperature of the thermal diffusion roll 616 comes to reach the intermediate temperature more quickly.

Further, from the same standpoint, the surface of the thermal diffusion roll 616 may be formed of a material having high thermal conductivity, such as metal. Specifically speaking, aluminum (Al), copper (Cu), stainless steel and so forth are named.

Moreover, the outer circumferential length of the thermal diffusion roll 616 may be longer than an interval in supplying the sheets P to the nip portion N (an interval between two of the sheets P). To be more specific, in the case where the outer circumferential length of the thermal diffusion roll 616 is not more than the interval in supplying the sheets P to the nip portion N, there is a possibility that a part of the fixing belt 610 which does not contact the sheet P comes into contact with the entire circumferential surface of the thermal diffusion roll 616. As described above, this part is the high temperature portion on the surface of the fixing belt 610. Consequently, the surface of the thermal diffusion roll 616 is heated all around, and the surface temperature is likely to be raised beyond the intermediate temperature, which is a preferred surface temperature. As a result, temperature fluctuations are likely to be caused on the surface of the thermal diffusion roll 616, and thereby efficient thermal diffusion of the fixing belt 610 is hardly performed.

On the other hand, in the case where the outer circumferential length of the thermal diffusion roll 616 is longer than the interval in supplying the sheets P to the nip portion N, both high temperature portion and low temperature portion of the fixing belt 610 come into contact with the surface of the thermal diffusion roll 616. In such a case, temperature fluctuations in the thermal diffusion roll 616 hardly occur.

Furthermore, in the exemplary embodiment, the thermal diffusion roll 616 may be arranged in contact with the surface of the fixing belt 610 that comes into contact with the sheet P (outer circumferential surface). Since the thermal diffusion roll 616 is arranged in this manner, thermal diffusion on the surface of the fixing belt 610 that comes into contact with the sheet P is performed with increased efficiency. On the other hand, if the thermal diffusion roll 616 is arranged on the surface of the fixing belt 610, which is opposite to the above-mentioned surface, that comes into contact with the fixing roll 611 (inner circumferential surface), even though the temperature variation on this surface may be suppressed, it is impossible to suppress the temperature variation on the outer circumferential surface of the fixing belt 610 in some cases. Because the fixing belt 610 has a thickness, the thermal diffusion on the outer circumferential surface of the fixing belt, which is the surface to be in contact with the sheet P, is not performed, and thereby temperature variation is not suppressed.

It should be noted that two thermal diffusion rolls 616 may be provided on both outer circumferential surface and inner circumferential surface of the fixing belt 610 to sandwich the fixing belt 610.

Further, it should be noted that the thermal diffusion member (temperature gradient relieving unit) is the thermal diffusion roll 616, which is a rotation body, in the aforementioned example, but not limited thereto. The thermal diffusion member might be other than the rotation body. However, from the standpoint of reduction of sliding resistance between the thermal diffusion member and the fixing belt 610, the thermal diffusion member may be the rotation body that rotates along with the movement of the fixing belt 610.

Moreover, in the aforementioned example, the thermal diffusion roll 616 is provided at a position on the insertion side of the sheet P and adjacent to the nip portion N, but not limited thereto.

Figure 4:
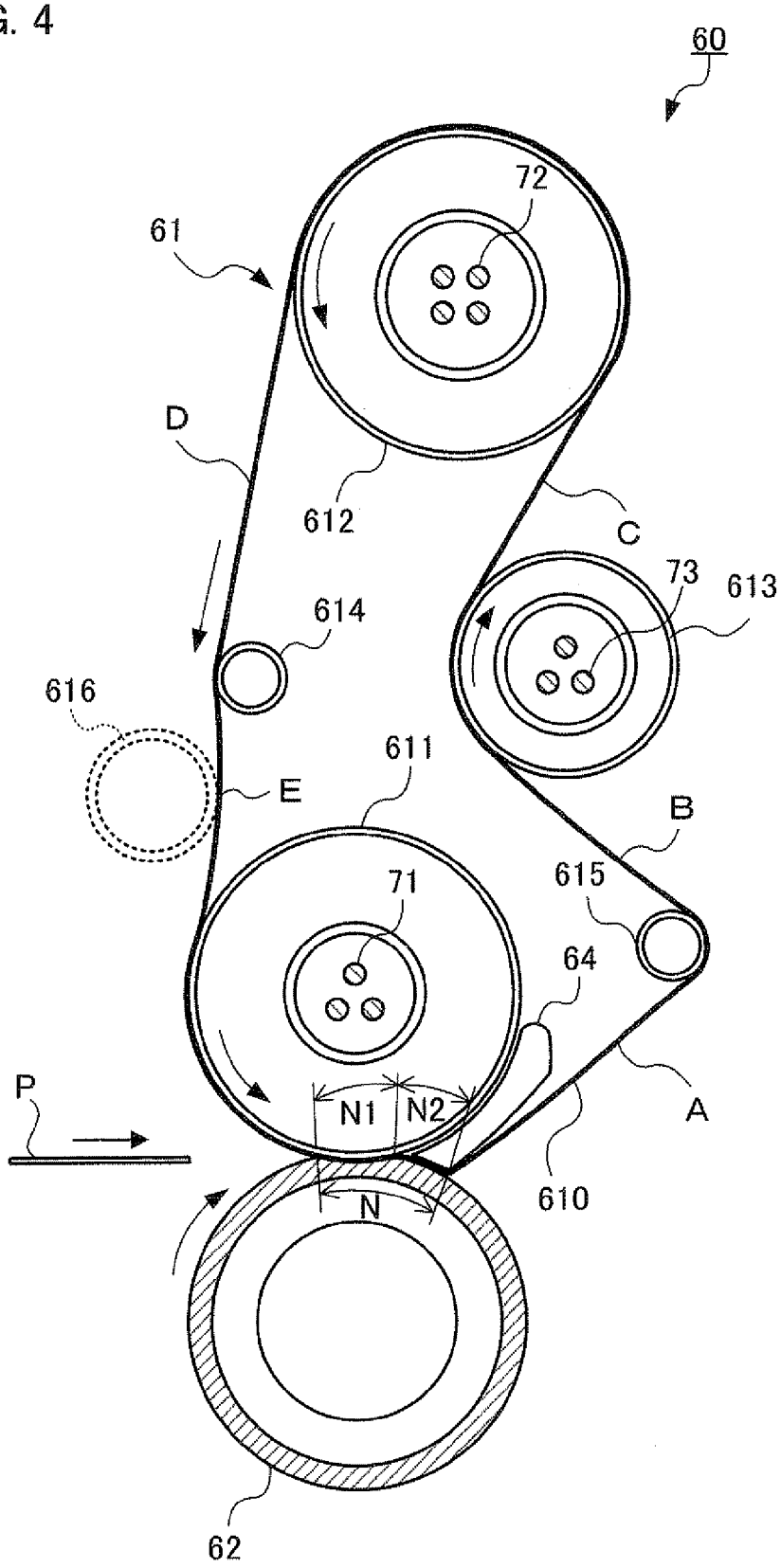
FIG. 4 illustrates examples of arrangement of a thermal diffusion roll.

FIG. 4 illustrates examples of arrangement of the thermal diffusion roll 616.

The position A shown in FIG. 4 is an example of arranging the thermal diffusion roll 616 at a location on the discharge side of the sheet P and adjacent to the nip portion N. The position A may translate into a position between the fixing roll 611 and the tensioning roll 615. Similarly, the position B shown in FIG. 4 is a position between the tensioning roll 615 and the outside heating roll 613. Further, the position C shown in FIG. 4 is a position between the outside heating roll 613 and the inside heating roll 612, and the position D shown in FIG. 4 is a position between the inside heating roll 612 and the tensioning roll 614. The position E shown in FIG. 4 is the same as the position of the thermal diffusion roll 616 shown in FIG. 2, which is between the tensioning roll 614 and the fixing roll 611. The position E may be captured as the position on the insertion side of the sheet P and adjacent to the nip portion N. It should be noted that, in FIG. 4, as the position where the thermal diffusion roll 616 is arranged, the position E is exemplified by a dotted line in the case where the thermal diffusion roll 616 is arranged in contact with the outer circumferential surface of the fixing belt 610.

Among these positions A to E, the thermal diffusion roll 616 may be arranged at the position A or the position E. In the case where the thermal diffusion roll 616 is arranged at the position A, the fixing belt 610 is immediately after passing through the nip portion N, and therefore the widest range of temperature variation is caused on the surface of the fixing belt 610. Accordingly, it is considered that thermal diffusion on the surface of the fixing belt 610 using the thermal diffusion roll 616 carried out in this stage may enhance the effect of suppressing the temperature variation.

In the case where the thermal diffusion roll 616 is arranged at the position E, the part of the fixing belt 610 where the thermal diffusion is performed is just prior to entering into the nip portion N. The fixing belt 610 reaches the nip portion N before the effect of thermal diffusion wears off by causing the thermal diffusion to be carried out on the surface of the fixing belt 610 using the thermal diffusion roll 616 at this location. Consequently, it is considered that the effect of suppressing the temperature variation is increased. Specifically, though the temperature variation on the surface of the fixing belt 610 is suppressed by the thermal diffusion roll 616, the temperature variation inside of the fixing belt 610 remains in some cases because of the thickness of the fixing belt 610. In such a case, after a lapse of time, the temperature variation on the surface of the fixing belt 610, which has been suppressed on one occasion, revives due to thermal transfer from the inside of the fixing belt 610. Since the position E is closer to the nip portion N than the other positions B, C and D, the part where the temperature variation is suppressed by the thermal diffusion roll 616 enters into the nip portion N in a short time. Accordingly, the surface of the fixing belt 610 is less susceptible to the aforementioned temperature variation inside of the fixing belt 610 in the case where the thermal diffusion roll 616 is arranged at the position E.

EXAMPLES

(1) Relation between Arrangement Position of Thermal Diffusion Roll 616 and Temperature Variation (Configuration of Fixing Unit 60)

Example 1

Fixing Operation is Performed by Using the Fixing Unit 60 Shown in FIG. 2

In the fixing unit 60, the fixing belt 610 is configured with a base layer that is made of polyimide resin and having a circumferential length of 525 mm (with a thickness of 80 μm), an elastic body layer made of silicone rubber (with a thickness of 400 μm) and a release layer made of PFA (with a thickness of 30 μm). As the fixing roll 611, a base of a hollow cylindrical roll, which is made of aluminum and having a diameter of 65 mm (with a thickness of 10 mm), coated with a PFA (with a thickness of 500 μm) is used. Further, the pressure roll 62 is configured with a base of a hollow cylindrical roll, which is made of aluminum and having a diameter of 100 mm (with a thickness of 10 mm), an elastic body layer made of silicone rubber (with a thickness of 10 mm) and a release layer made of PFA (with a thickness of 150 μm) laminated in the order of aluminum, silicone rubber, PFA. As the thermal diffusion roll 616, a hollow cylindrical body that is made of aluminum and having a diameter of 40 mm and a thickness of 3 mm is used. The thermal diffusion roll 616 is arranged at the position 25 mm away from the nip portion N along the fixing belt 610 in the moving direction thereof (namely, the position shown as the position A in FIG. 4), while being in contact with the surface of the fixing belt 610 that comes in contact with the fixing roll 611 (inner circumferential surface). On this occasion, the wrap length of the fixing belt 610 on the thermal diffusion roll 616 is 15 mm.

As the sheet P, J-paper manufactured by Fuji Xerox Co., Ltd. (A3 size, basis weight of 82 g/m$^2$) is used. A continuous operation of the fixing unit 60 is performed with an interval of 114 mm between the sheets P and at the process speed of 445 mm/s. The surface temperatures of the fixing belt 610 and the pressure roll 62 are controlled at 150° C. and 70° C., respectively.

Example 2

The operation of the fixing unit 60 is performed in a similar manner as Example 1 except that the thermal diffusion roll 616 is arranged in contact with the surface of the fixing belt 610 that comes in contact with the sheet P (outer circumferential surface).

Example 3

The operation of the fixing unit 60 is performed in a similar manner as Example 1 except that two thermal diffusion rolls 616 are prepared and arranged on both sides of the fixing belt 610, namely, on the outer circumferential surface and the inner circumferential surface, to sandwich the fixing belt 610.

Examples 4 to 6

The operation of the fixing unit 60 is performed in a similar manner as each of Examples 1 to 3 except that the thermal diffusion roll 616 is arranged at the position shown as the position B in FIG. 4.

Examples 7 to 9

The operation of the fixing unit 60 is performed in a similar manner as each of Examples 1 to 3 except that the thermal diffusion roll 616 is arranged at the position shown as the position C in FIG. 4.

Examples 10 to 12

The operation of the fixing unit 60 is performed in a similar manner as each of Examples 1 to 3 except that the thermal diffusion roll 616 is arranged at the position shown as the position D in FIG. 4.

Examples 13 to 15

The operation of the fixing unit 60 is performed in a similar manner as each of Examples 1 to 3 except that the thermal diffusion roll 616 is arranged at the position shown as the position E in FIG. 4.

Comparative Example 1

The operation of the fixing unit 60 is performed in a similar manner as Example 1 except that the thermal diffusion roll 616 is not provided.

[Evaluation of Temperature Variation]

The operation of the fixing unit 60 is performed until fixing on 10 sheets P is completed, and thereafter, temperature on each part of the outer circumferential surface of the fixing belt 610 is measured. The difference between the highest temperature and the lowest temperature is assumed to be the value of temperature variation. In this case, it is meant that the smaller the value, the less the temperature variation, and thus the temperature variation of the fixing belt 610 is suppressed.

[Evaluation Result]

The values of temperature variation in Examples 1 to 15 and Comparative Example 1 are shown in Table 1. The unit of numeric values in Table 1 is "° C.". The results in Table 1 presented in graphical form are shown in FIG. 5.

TABLE 1

| | Position A | Position B | Position C | Position D | Position E |
|---|---|---|---|---|---|
| Inner Circumferential Surface | 2.25 | 2.20 | 2.15 | 2.13 | 2.12 |
| Outer Circumferential Surface | 1.05 | 1.75 | 1.68 | 1.24 | 1.10 |
| Both Surface | 1.02 | 1.70 | 1.54 | 1.12 | 1.05 |

Figure 5:
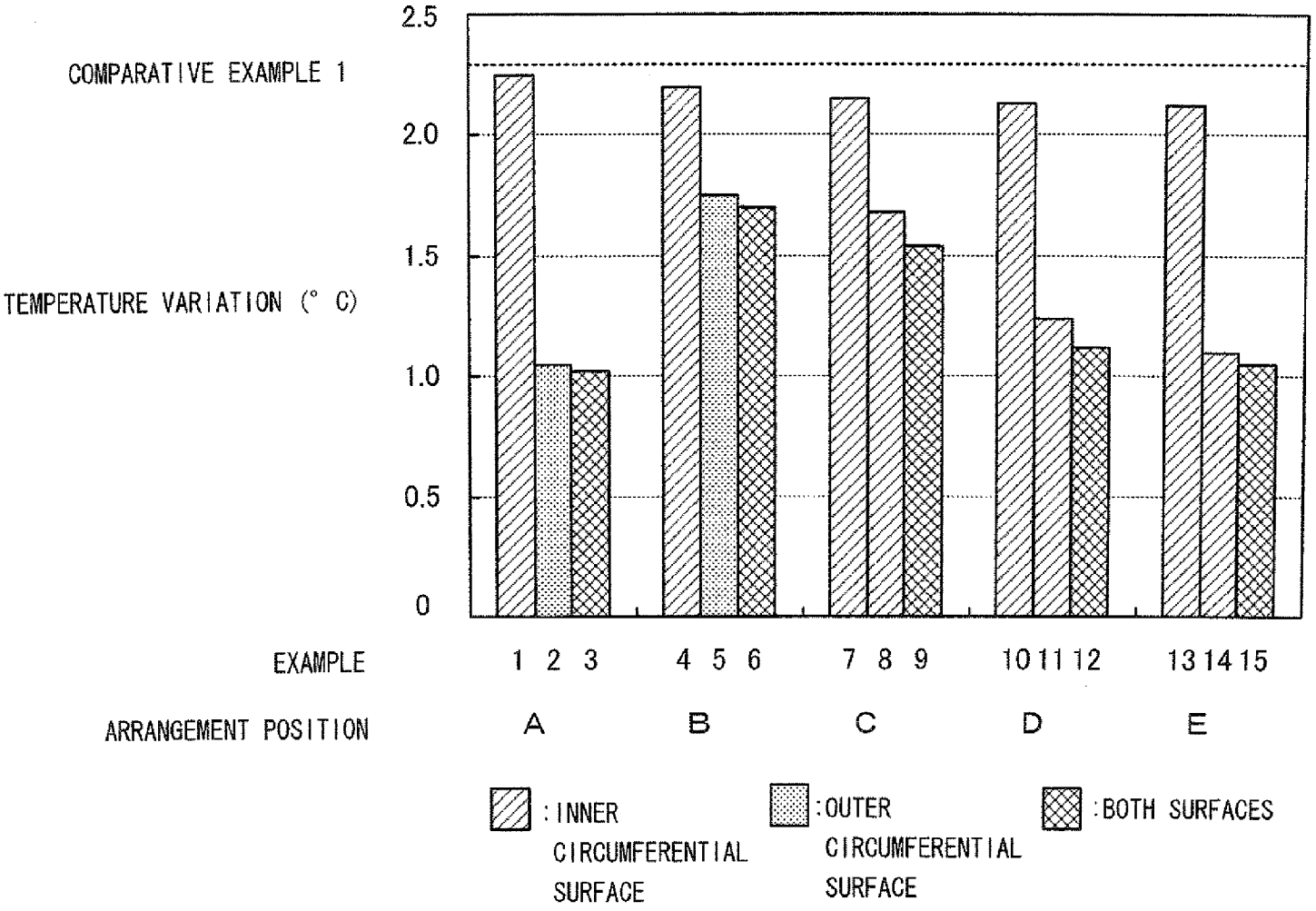
FIG. 5 illustrates a relation between an arrangement position of the thermal diffusion roll and the temperature variation of the fixing belt.

As shown in FIG. 5, the value of temperature variation in Comparative Example 1 is about 2.3° C. In contrast, the values of temperature variation in Examples 1 to 15 are smaller than that of the Comparative Example 1, and thereby it is learned that the temperature variation on the fixing belt 610 is suppressed.

As Examples 1 to 15 are mutually compared, it is found that the value of temperature variation significantly decreases in the case where the thermal diffusion roll 616 is arranged in contact with the outer circumferential surface of the fixing belt 610 in comparison with the case where the thermal diffusion roll 616 is arranged in contact with the inner circumferential surface of the fixing belt 610. The value of temperature variation further decreases if two thermal diffusion rolls 616 are provided on both surfaces of the fixing belt 610.

It should be noted that, in the exemplary embodiment, there is a case where the value of temperature variation does not decrease so much when the thermal diffusion roll 616 is arranged in contact with the inner circumferential surface of the fixing belt 610 as compared to Comparative Example 1 in which no thermal diffusion roll 616 is provided. It is considered this is due to the short contact time between the thermal diffusion roll 616 and the fixing belt 610. In such a case, it is possible to suppress the temperature variation of the fixing belt 610 by slowing down the process speed of the fixing unit 60 or extending the wrap length of the fixing belt 610 on the thermal diffusion roll 616.

Moreover, in the exemplary embodiment, it is learned that the value of temperature variation is small in the case where the thermal diffusion roll 616 is arranged at position A or position E as compared to other positions when the thermal diffusion roll 616 is arranged in contact with the outer circumferential surface of the fixing belt 610 or two thermal diffusion rolls 616 are provided in contact with both surfaces of the fixing belt 610.

(2) Relation between Wrap Length of Fixing Belt 610 on Thermal Diffusion Roll 616 and Temperature Variation (Evaluation of Temperature Variation)

In Example 11, the thermal diffusion roll 616 is moved laterally in the figure to vary the wrap length of the fixing belt 610 on the thermal diffusion roll 616, and thereafter, a change in the value of temperature variation is examined.

[Evaluation Result]

Figure 6:
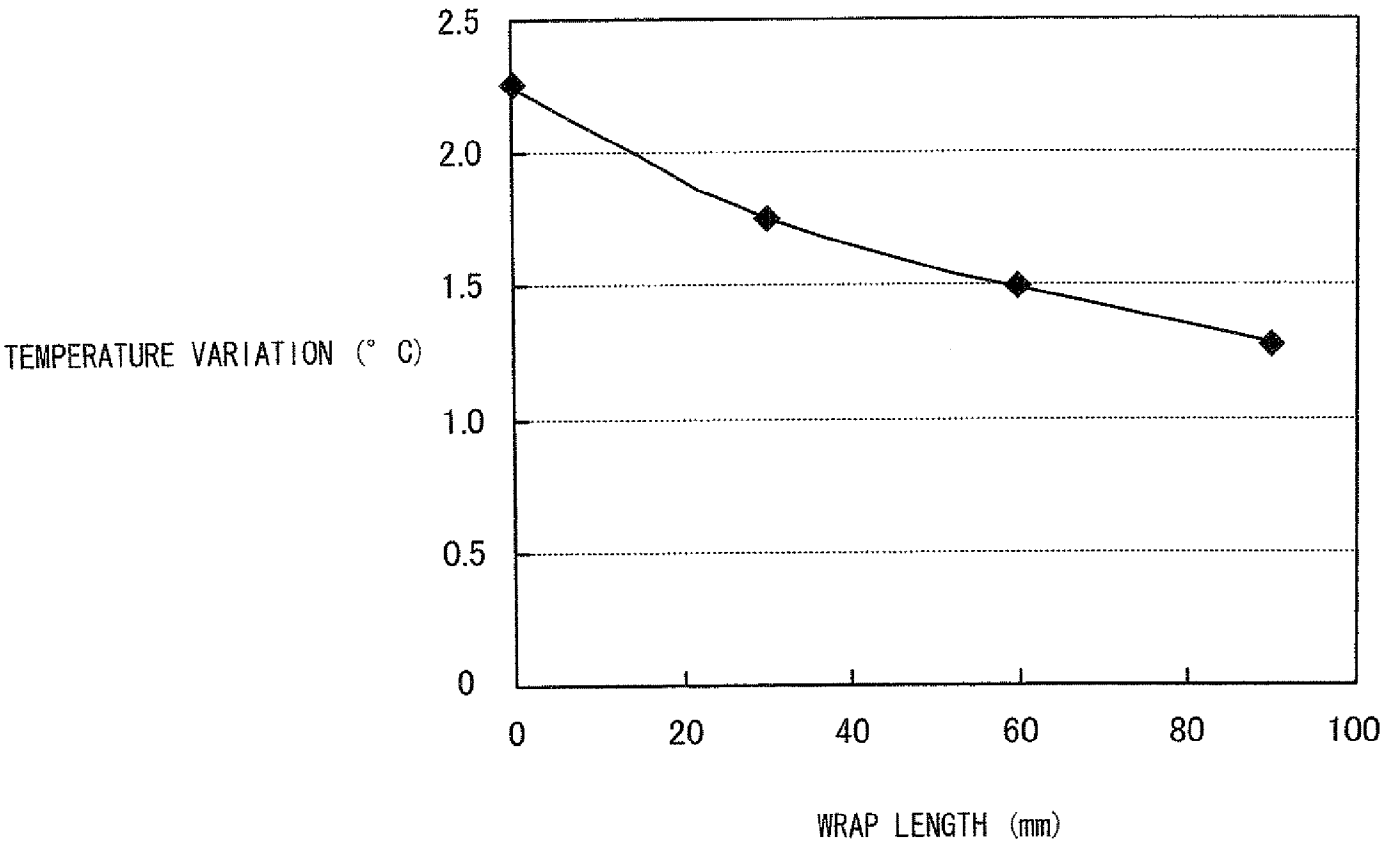
FIG. 6 illustrates a relation between a wrap length of the fixing belt on the thermal diffusion roll and the temperature variation of the fixing belt.

The result is shown in FIG. 6.

As shown in FIG. 6, the value of temperature variation decreases as the wrap length of the fixing belt 610 on the thermal diffusion roll 616 is made longer. That is, the longer the wrap length, the more likely the temperature variation of the fixing belt 610 is suppressed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes a toner image on a recording medium;

a pressure member that forms a fixing pressure portion between the pressure member and the fixing member by making pressure contact with an outer circumferential surface of the fixing member, the fixing pressure portion being passed through by the recording medium holding an unfixed toner image;

a heat supplier that supplies heat to the fixing member; and a thermal diffusion member that diffuses heat on a surface of the fixing member by contact with the fixing member, wherein the thermal diffusion member is a rotation body that rotates along with movement of the fixing member, and an outer circumferential length of the rotation body is longer than an interval between a plurality of the recording medium fed to the fixing pressure portion.

2. The fixing device according to claim 1, wherein the thermal diffusion member is arranged in contact with the outer circumferential surface of the fixing member.

3. The fixing device according to claim 2, wherein the thermal diffusion member is arranged at a position adjacent to the fixing pressure portion.

4. The fixing device according to claim 3, wherein the thermal diffusion member is a rotation body that rotates along with movement of the fixing member.

5. The fixing device according to claim 4, wherein an outer circumferential length of the rotation body is longer than an interval between a plurality of the recording medium fed to the fixing pressure portion.

6. The fixing device according to claim 2, wherein the thermal diffusion member is a rotation body that rotates along with movement of the fixing member.

7. The fixing device according to claim 6, wherein an outer circumferential length of the rotation body is longer than an interval between a plurality of the recording medium fed to the fixing pressure portion.

8. The fixing device according to claim 1, wherein the thermal diffusion member is arranged at a position adjacent to the fixing pressure portion.

9. The fixing device according to claim 1, wherein the thermal diffusion member has a hollow portion inside of the thermal diffusion member.

10. The fixing device according to claim 1, wherein a surface of the thermal diffusion member is formed of metal.

11. The fixing device according to claim 1, wherein the heat supplier includes an inside heating unit positioned on one side of the fixing member and an outside heating unit positioned on another side of the fixing member.

12. The fixing device according to claim 11, wherein the outside heating unit is positioned after the fixing pressure portion and before the inside heating unit in a moving direction of the fixing member.

13. The fixing device according to claim 1, wherein the heat supplier is not present in a path between the thermal diffusion member and the fixing pressure portion in moving direction of the fixing member.

14. A fixing device comprising:

a fixing member that fixes a toner image on a recording medium;

a pressure member that forms a fixing pressure portion between the pressure member and the fixing member by making pressure contact with an outer circumferential surface of the fixing member, the fixing pressure portion being passed through by the recording medium holding an unfixed toner image;

a heat supplier that supplies heat to the fixing member; and a temperature gradient relieving unit that relieves a temperature gradient on the fixing member, which is caused after fixing of the toner image, by contact with the fixing member, wherein the temperature gradient relieving unit is a rotation body that diffuses heat of the fixing member and relieves the temperature gradient on the fixing member by rotating while making contact with the fixing member, and an outer circumferential length of the rotation body is longer than an interval between a plurality of the recording medium fed to the fixing pressure portion.

15. The fixing device according to claim 14, wherein the heat supplier includes an inside heating unit positioned on one side of the fixing member and an outside heating unit positioned on another side of the fixing member.

16. The fixing device according to claim 15, wherein the outside heating unit is positioned after the fixing pressure portion and before the inside heating unit in a moving direction of the fixing member.

17. The fixing device according to claim 14, wherein the heat supplier is not present in a path between the temperature gradient relieving unit and the fixing pressure portion in moving direction of the fixing member.

18. An image forming apparatus comprising:

a toner image forming unit that forms a toner image;

a transfer unit that transfers the toner image onto a recording medium, the toner image having been formed by the toner image forming unit; and a fixing device including:

a fixing member that fixes the toner image on the recording medium;

a pressure member that forms a fixing pressure portion between the pressure member and the fixing member by making pressure contact with an outer circumferential surface of the fixing member, the fixing pressure portion being passed through by the recording medium holding an unfixed toner image;

a heat supplier that supplies heat to the fixing member; and a thermal diffusion member that is a rotation body and that diffuses heat on a surface of the fixing member by contact with the fixing member, wherein an outer circumferential length of the rotation body is longer than an interval between a plurality of the recording medium fed to the fixing pressure portion.

19. The image forming apparatus according to claim 18, wherein the heat supplier includes an inside heating unit positioned on one side of the fixing member and an outside heating unit positioned on another side of the fixing member.

20. The image forming apparatus according to claim 19, wherein the outside heating unit is positioned after the fixing pressure portion and before the inside heating unit in a moving direction of the fixing member.

21. The image forming apparatus according to claim 18, wherein the heat supplier is not present in a path between the thermal diffusion member and the fixing pressure portion in moving direction of the fixing member.

* * * * *